US005228254A

United States Patent [19]

Honeycutt, Jr.

[11] Patent Number: 5,228,254

[45] Date of Patent: Jul. 20, 1993

[54] WALL SYSTEM

[75] Inventor: James R. Honeycutt, Jr., Zeeland, Mich.

[73] Assignee: Plascore, Inc., Zeeland, Mich.

[21] Appl. No.: 643,526

[22] Filed: Jan. 18, 1991

[51] Int. Cl.[5] ..... E04B 2/74

[52] U.S. Cl. ..... 52/241; 52/282; 52/284; 52/464; 52/468; 52/584

[58] Field of Search ..... 52/241, 242, 484, 488, 52/584, 464, 468, 282, 284, 220, 270

[56] References Cited

U.S. PATENT DOCUMENTS

| | | | |
|---|---|---|---|
| 3,423,892 | 1/1969 | Rimington | 52/241 |
| 3,707,060 | 12/1972 | Jansen, Jr. | 52/241 |
| 3,861,103 | 1/1975 | Rasmussen | 52/241 |
| 4,103,463 | 8/1978 | Dixon | 52/241 |
| 4,245,442 | 1/1981 | Durham | 52/241 |
| 4,361,994 | 12/1982 | Carver | 52/241 |
| 5,070,667 | 12/1991 | Schulte | 52/241 |

*Primary Examiner*—Michael Safavi

*Attorney, Agent, or Firm*—Warner, Norcross & Judd

[57] ABSTRACT

A domountable wall system is disclosed suitable for use as a clean room enclosure. Wall panels are provided with a pair of upwardly extending top flanges and a pair of downwardly extending bottom flanges. A head track affixed to the ceiling has a pair of longitudinal, downwardly opening recesses divided by an inner wall carrying resiliently flexible gaskets directed laterally into each of the recesses. The top flanges of the wall panel are inserted within the recesses straddling the gaskets and forming a seal therewith. A floor track is affixed to the floor directly below the head track. The bottom flanges of the wall panel rest atop ledges on the floor track spaced above the floor. The wall panel, and the top flanges within the recesses, may be raised and lowered and the bottom of the wall panel swung in and out for installation and demounting of the wall panel. The gaskets are advantageously formed as dual durometer extrusions. Special constructed batten strips and corner posts are also disclosed.

35 Claims, 5 Drawing Sheets

WALL SYSTEM

BACKGROUND OF THE INVENTION

1. Field of the Invention

The present invention relates to a wall construction and, more particularly, to an easily installable and demountable prefabricated wall system.

2. Description of the Related Art

Demountable wall systems are frequently employed to provide a room enclosure. In the past, conventional demountable wall systems have comprised prefabricated components generally including a relatively elaborate supporting framework with vertical studs extending from floor to ceiling, wall panels, a means for attaching the panels to the framework, and various trim elements and appurtenances. The wall panels have been attached to the framework or studs by fasteners such as screws or bolts, or by snap-in arrangements wherein the panels have edge flanges engaging recesses in the frame members.

Framed demountable wall systems have been provided as single-sided, having wall panels on only one side of the framework, or as double sided, having wall panels on both sides of the framework. In double-sided walls, either the framing elements must have wall panel attachments on both sides, or two sets of one-sided framing elements must be used back to back. Whether single-sided or double-sided, such framed wall systems require a relatively large number of components and a great deal of installation time and effort.

More recently, studless demountable wall systems have been provided. Such studless systems generally employ a head track affixed to the room ceiling, a base runner affixed to the room floor, and wall panels extending between the head track and the floor runner. The absence of studs or other floor-to-ceiling framing and the reduction of the number of components greatly reduces the expense of fabrication and installation.

Studless wall systems have been provided as single-sided or double-sided. In double-sided applications, either a pair of back-to back wall panels is used, or a single wall panel is provided with wall facings on both sides.

Several performance considerations are important in the design, manufacture, and installation of demountable wall systems. It is desirable that the components be completely shop-fabricated, with a minimum of cutting, fitting, or finishing effort required of the installers at the room site. When installed, the wall should present a smooth and continuous surface with adjacent wall panels in planar alignment. The system should be installable in as little space as possible. Variations or movement in the floor or ceiling should be accommodated. The wall system should eliminate the transmission of vibrations between floor and ceiling.

Demountable wall systems may be used as clean rooms. In this application, an enclosure is required in which a highly sanitary and uncontaminated environment may be maintained. For example, clean rooms are often used in facilities for the manufacture and assembly of electronic components, or as laboratories in the biological sciences. The walls of clean rooms must have flat and smooth surfaces which will not tend to catch and accumulate dust and other contaminants an which will not interfere with a laminar flow of room air. The wall surfaces must be smooth and durable to facilitate cleaning. The vertical seams between panel edges should be easily sealed, even when one or both panel edges have been field cut. The details of the panel edge connections should not interfere with the installation of the panel in tight spaces.

Each of the wall systems known in the past have failed to satisfy one or more of the above-mentioned criteria. For example, framed systems require a large degree of field fabrication and installation effort. Snap-on or fastener mounted panels require special panel edge details making it impracticable to field cut a panel to a narrower width. Systems having wall panels extending substantially the entire distance from floor to ceiling require that the panels be installed and removed by swinging the top or bottom of the panel into the room a substantial distance in order to clear the floor and ceiling.

One type of studless, double-sided wall system employs a downwardly opening channel head track and wall panels having resilient gaskets along the top edges of the wall panels which are received within the channel. Since each wall panel has its own pair of top edge gaskets, there is a break between the gaskets of adjacent panels which allows the panels to fall out of alignment and which forms a discontinuity in the seal between the panels and the channel.

Thus there is an unmet need for a demountable wall system that is studless, requires a minimum of field fabrication and finishing, is economically manufactured, is easily installed in a minimum of space, provides vibration isolation, is self-aligning, is suitable for use as a clean room enclosure, and that otherwise meets all the aforementioned criteria.

SUMMARY OF THE INVENTION

The present invention satisfies the aforementioned need by providing a demountable wall system having double-faced wall panels, a floor track which elevates the bottom of the panels above the bottom of the floor, and a head track having an inner wall with continuous resilient gaskets. According to the invention, a wall panel is provided having laterally spaced-apart front and rear faces. The top edges of the front and rear faces are provided with upwardly extending, parallel, longitudinal flanges. The bottom edges of the faces are provided with downwardly extending, parallel, longitudinal flanges. Preferably, the outer surfaces of these flanges are continuous with the outer surfaces of the front and rear panel faces.

A head track is provided affixed to the room ceiling or other suitable overhead structure extending longitudinally along the top line of the wall being erected. A floor track is similarly affixed to the room floor directly below the head track. The head track is formed as an elongated member having a cross-section generally in the form of a downwardly opening channel including a web portion lying against the room ceiling and front and rear outer legs extending downwardly from the edges of the web. The head track further includes an inner divider including a pair of downwardly extending inner legs extending longitudinally within the interior of the head track. The inner legs are spaced apart from and parallel to the head track outer legs, thereby forming a pair of longitudinal, downwardly opening recesses therebetween.

Carried along the lower edges of the head track inner legs, there are provided longitudinal resilient gaskets extending laterally into the recesses between the inner and outer legs. Advantageously, the gaskets are made of a synthetic rubber material and have a longitudinal connector dart portion of a relatively higher durometer value engaging a slotted recess along the outer side of the lower edge of each inner leg, and a longitudinal tubular portion of a relatively lower durometer value disposed outwardly of the dart portion.

The floor track is formed as an upwardly opening channel having two spaced-apart and parallel upstanding legs. The upper edges of the floor track legs are formed with inwardly extending ledges having spacer wall portions extending upwardly from the inner edges of the ledges.

When the clean room wall system of the invention is installed, the top flanges of the wall panel are each disposed in one of the recesses of the head track between the outer and inner legs thereof. The gaskets contact the inner surfaces of the wall panel top flanges and are compressed thereagainst. The bottom edges of the wall panel bottom flanges rest atop the ledges of the floor track, maintained in proper position thereon by the spacer wall portions.

Since the resilient gaskets according to the invention are carried by the head track rather than the wall panels, the gaskets may be provided in any desired length. Advantageously, the gaskets will extend the entire length of the head track in continuous engagement with a plurality of wall panels inserted in the track. The continuity of the gaskets aids in maintaining the coplanar relationship of adjacent wall panels and in forming a continuous seal between the head track and the wall panels.

The gaskets prevent direct contact between the rigid components of the head track and wall panel. This mechanical isolation prevents the transmission of vibrations between the ceiling, where ventilating equipment may be operating, and the wall and floor. Continuous, smooth surfaces are provided on both sides of the wall which are easily cleaned, have no irregularities on which particulate contaminants would be caught, and which promote the laminar flow of air. Furthermore, the head track and wall panels are provided with a range of vertical movement with respect to each other to accommodate ceiling sag or other variations in the floor-to-ceiling distance.

According to a feature of the invention, the vertical seams between adjacent panel edges are provided with batten strips. A batten strip is installed on each face of each seam having flanges overlying the portions of the panel faces adjacent the seam. The batten strips have central bodies protruding inwardly toward each other between the panel edges. The central body of one batten strip has an inner groove, while the opposed batten strip has an outer recess. A threaded fastener is inserted into the outer recess of one batten strip, through the thickness of the wall, and into the groove of the opposed batten strip. The adjacent panel edges are thus captured between the two batten strips and held in alignment thereby.

The upper and lower portions of the central bodies of the batten strips are cut away or absent such that the flanges extend vertically beyond the central bodies. This absence of the central bodies at the batten strip ends is provided so that there will be no interfering contact with the head track and floor track. Preferably, the flanges at the top of the batten strips extend approximately one and one-half inches beyond the central bodies; the bottom ends of the batten strip flanges extend approximately one-quarter inch beyond the central bodies. The inner and outer recesses of the head track are sufficiently wide so as to allow the insertion of the upper ends of the batten strip in much the same manner as the wall panel flanges.

According to an additional feature of the invention, a specially configured corner post is provided for use in the construction of inside or outside wall corners. The corner post is formed as an elongated L-shaped extrusion in which the upper and lower extents thereof are notched so that the post engages the head track and floor track in the same manner as a wall panel. Furthermore, the vertical seam between a wall panel and the corner post is assembled with batten strips in the same manner described above.

Installation of the wall system of the invention is accomplished by first affixing the head track and floor track to the room ceiling and floor, respectively, with suitable fasteners such as self-drilling, self-tapping screws extending through the track webs. Each wall panel is successively brought into position alongside the tracks and installed therebetween. Each of the components is dimensioned such that when the bottom edges of the wall panel rest on or near the floor, there is clearance between the top edges of the wall panel top flanges and the lower extent of the head track. The wall panel is then tilted toward the head track so that the top flanges lie below the head track recesses in alignment therewith. The wall panel is then raised so that the top flanges enter the head track recesses with the gaskets engaging the inner surfaces of the top flanges, thus serving to center the upper edge of the wall panel in alignment with the head track and to form a seal.

The depth of the head track recesses is dimensioned so as to allow the wall panel then to be raised a distance sufficient for the bottom edges of the bottom flanges to clear the upper extent of the floor track. The lateral width of the recesses is sufficient to allow the bottom of the wall panel to be swung in and out clearing the floor track. The bottom of the wall panel is then swung toward the floor track until the bottom edges of the bottom flanges lie directly above the floor track ledges. Finally, the wall panel is lowered until the bottom edges of the bottom flanges rest upon the floor track ledges, centered thereon by the engagement of the spacer wall portions with the inner surfaces of the bottom flanges.

A pair of batten strips is then installed at each of the vertical seams between wall panels or between a wall panel and a corner post. One batten strip is placed over the front face of the seam and a second over the rear face. Both batten strips have their upper ends extending upwardly into the head track recesses. Screws are installed at vertically spaced intervals through the recessed batten into the grooved batten.

If the room is configured with an inside or outside corner, the head and floor tracks are fabricated with mitered joints. A corner post as described above is tilted and lifted into place at the corner in the same manner as the installation of the wall panels. Batten strips are used to secure the wall panel edges to the corner post edges.

The wall panel system of the invention is demounted by reversing the procedure described above.

By providing a floor track which spaces the bottom edges of the wall panel upwardly away from the floor, the wall panel may be installed and demounted by tilting it only a few inches. The panels may be repeatedly removed and installed without damage to the panels, tracks, batten strips, corner posts, or gaskets. The gaskets remain in assembled relationship with the head track inner legs.

According to a feature of the invention, the bottom track provides a cavity suitable for receiving conduits such as electrical or communications wires. According to an additional feature, the head track may be formed with upper and lower longitudinal webs also forming a wire or conduit carrying cavity.

These and other objects, advantages, and features of the present invention will be more fully understood and appreciated by reference to the written specification and appended drawings.

DESCRIPTION OF THE PREFERRED EMBODIMENT

Figure 1:
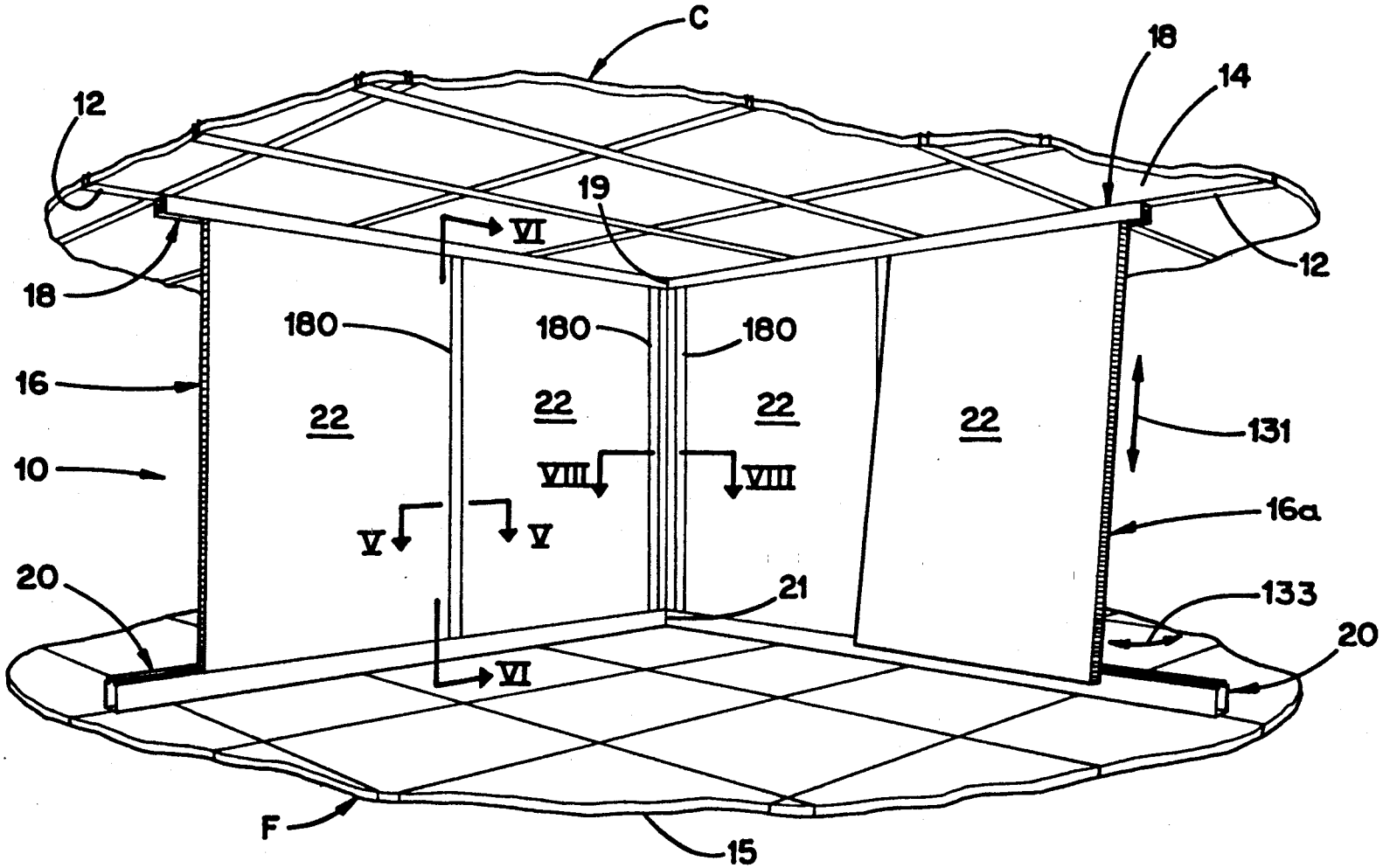
FIG. 1 is a perspective, fragmentary view of a clean room and a clean room wall system according to the principles of the invention.

By way of disclosing a preferred embodiment, and not by way of limitation, there is shown in FIG. 1 a portion of a room wall 10 extending generally vertically between a floor F and a ceiling C. The ceiling is shown as a well-known construction of grid suspension members such a member 12 and ceiling panels 14 resting in the grid openings defined by the suspension members. In rooms such as clean rooms, it will be understood that the ceiling may include air filter and ventilation units and special means for ensuring a seal between the ceiling panels 14 and the suspension members, all in well known manners. The floor F may be of the raised access floor variety in which floor panels 15 are supported atop pedestals and stringers in well known fashion. The wall system of the invention may be used with other types of ceiling and floor constructions that provide structures to which the head and floor tracks may be affixed.

The wall system, in its general organization, includes several vertically extending wall panels 16 forming two walls meeting perpendicularly in an inside corner, two sections of elongated head track 18 affixed to the ceiling extending along the top edges of the wall 10 and meeting at a mitered corner joint 19, and elongated floor tracks 20 affixed to the floor directly below the head tracks 18 extending along the bottom edges of the wall panel 16 and meeting at a mitered corner joint 21. The major surfaces of the wall panels include a front face 22 and a rear face 24 (FIG. 2) in generally vertical, parallel and spaced-apart relationship. The top edge of each wall panel is engaged and supported by a head track 18, while the bottom edge of each wall panel is engaged and supported by a floor track 20, as described in greater detail below.

At the corner intersection between the two walls there is installed a corner post 160. As described in detail below, the corner post is an elongated member having an L-shaped cross section extending between the corner joint 19 of the head track and the corner joint 21 of the floor track. Corner post 160 forms an inside corner on the side of the room visible in FIG. 1 and an outside corner on the opposite side thereof.

Each of the vertical seams between adjacent wall panels, and between a wall panel and the corner post, is provided with a pair of batten strips including front batten strips 180 and rear batten strips 182 (FIGS. 5 and 6) which grasp the panel and corner post vertical edges and hold them in sealed alignment.

Wall panel 16*a* of FIG. 1 is shown in a partially installed condition with its top edge received in head track 18 and its bottom edge tilted outwardly away from floor track 20. As described more fully below, the wall panels are installed and demounted by lifting and lowering as indicated by arrow 131, and by tilting in and out as indicated by arrow 133.

It will be appreciated by those skilled in the art that a completed wall construction will have additional walls defining an enclosure. Additional head and floor tracks will be used along each wall. Additional wall panels will be used with their vertical edges in adjacency. Furthermore, selected wall panels may be formed with windows, doors, or other desired appurtenances in known manners.

Figure 2:
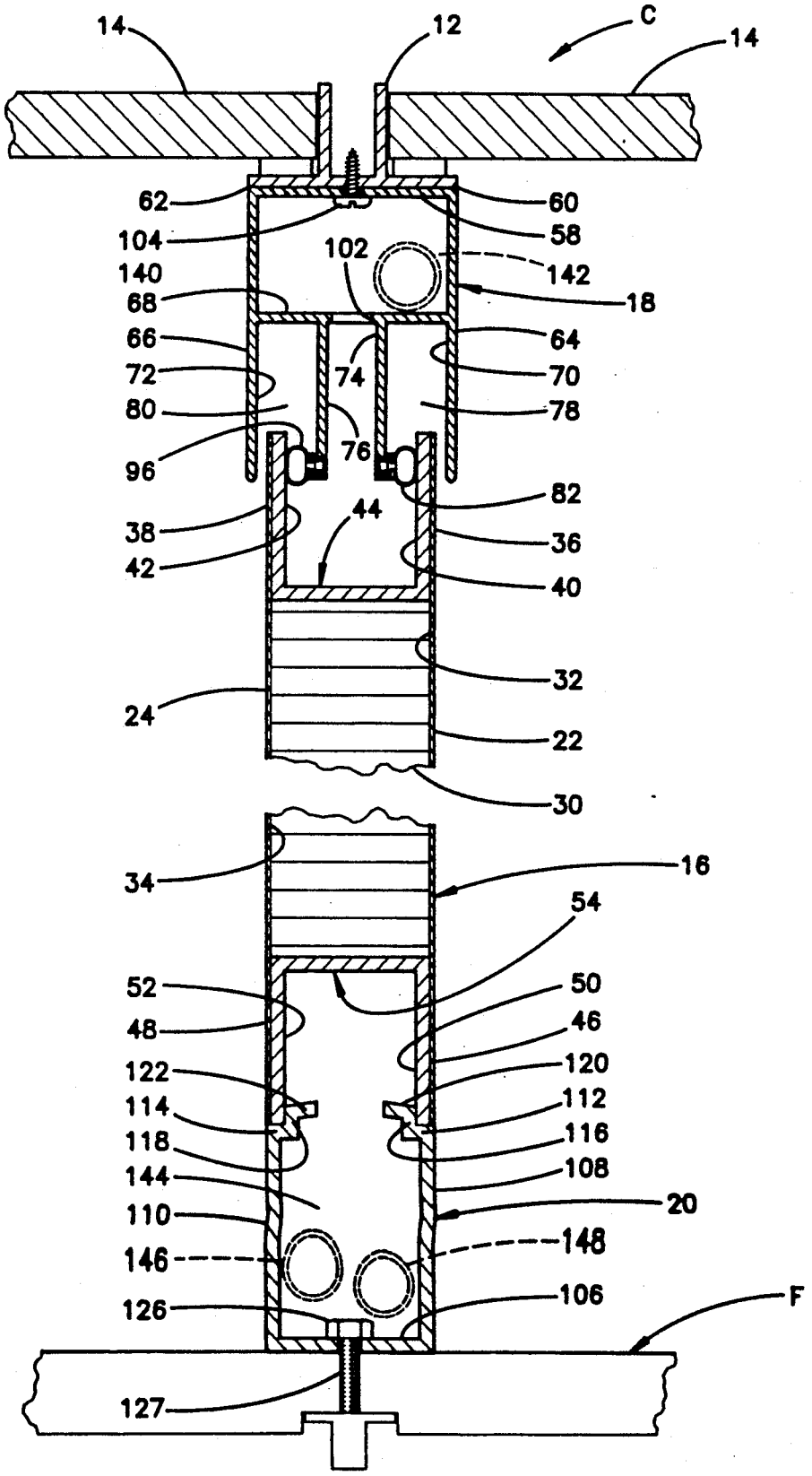
FIG. 2 is a vertical, sectional view of the wall system of FIG. 1.

As shown in FIG. 2, each wall panel 16 includes a honeycomb structural core 30 of aluminum sheet, although other types of cores such as corrugated fibrous material may be used. The front and rear faces 22, 24 are formed as thin plates 32, 34 of aluminum bonded to the core by a suitable non-outgassing structural adhesive. The outer surfaces of the front and rear faces are preferably coated with a smooth, durable, chemical resistant and readily cleanable coating such as a roll-coated polyester or epoxy baked enamel.

Formed along the upper edge of the wall panel 16 are front and rear top flanges 36, 38 extending in laterally spaced-apart, longitudinally parallel relationship. The top flanges 36, 38 are formed by the upstanding legs 40, 42 of extruded aluminum top channel 44 disposed longitudinally along the top edge of the core 30. The plates 32 and 34 of the wall panel extend upwardly and overlie the outer surfaces of the channel legs 40, 42 so as to form smooth and continuous upper surfaces on the front and rear faces 22, 24.

Formed along the lower edge of the wall panel 16, in a manner similar to the upper edge, are front and rear bottom flanges 46, 48 extending in laterally spaced-apart, longitudinally parallel relationship. The bottom flanges 46, 48 are formed by the downwardly extending legs 50, 52 of extruded aluminum bottom channel 54 disposed longitudinally along the bottom edge of the core 30. The plates 32 and 34 of the wall panel extend downwardly and overlie the outer surfaces of the channel legs 50, 52 so as to form smooth and continuous lower surfaces on the front and rear faces 22, 24.

Head track 18 is formed as a longitudinally extending aluminum extrusion having an horizontal upper web 58 with laterally spaced-apart front and rear edges 60, 62. Front and rear outer legs 64, 66 extend downwardly from the edges 60, 62 in spaced-apart parallel relationship. An inner web 68 extends horizontally between the intermediate extent of the opposed inner surfaces 70, 72 of the legs 64, 66.

The space defined between the outer legs 64, 66 is divided by an inner wall comprising front and rear inner legs 74, 76 extending downwardly from the intermediate extent of the inner web 68. Inner legs 74, 76 run longitudinally in the space between the outer legs 64, 66 inwardly spaced-apart from the outer legs so as to divide the space into front and rear recesses 78, 80. Front and rear recesses 78, 80 open downwardly and extend longitudinally generally with the upper extents of the wall panel top flanges 36, 38 received therein.

Figure 3:
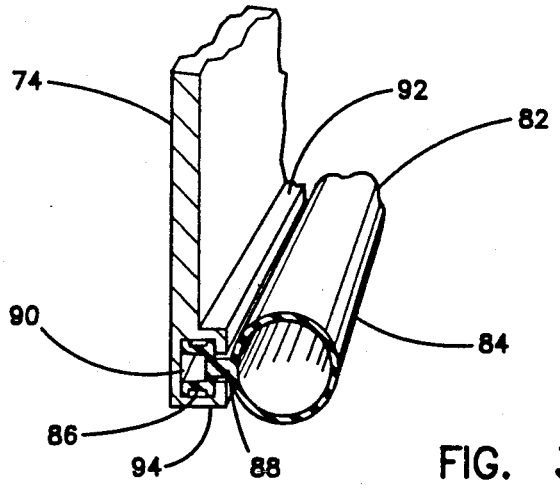
FIG. 3 is a fragmentary, perspective view showing details of the gasket and head track inner leg on an enlarged scale.

Referring additionally to FIG. 3, it may be seen that an elongated gasket 82 is carried on the forward extent of the bottom edge of head track inner leg 74. It is to be understood that the head track may be manufactured to any desired length and will preferably be provided as a single continuous length along the wall in which it will be assembled. Furthermore, the gaskets are advantageously provided as a continuous lengths extending the full lengths of the head tracks. In this manner, there are no gasket discontinuities at the vertical seams between wall panels which would disturb the planar alignment of the panels or interrupt the seal between the gaskets and the panel top flanges.

Each gasket is formed as a unitary profile having a tubular portion 84, a base portion 86, and a longitudinal neck 88 joining the tubular and dart portions. The base portion 86 is formed as a bifurcated dart dimensioned to be captured in a slotted recess 90 formed along the lower extent of the inner leg 74. The gasket neck 8 is disposed in the slot formed between two L-shaped lateral extensions 92, 94 of the inner leg 74.

Advantageously, the gasket 82 is formed as a dual durometer coextrusion of synthetic rubber. The tubular portion 84 is provided as having a relatively lower durometer value so that it may resiliently flex in response to the pressure imposed by the wall panel top flanges, while the dart portion is provided as having a relatively higher durometer value so that it is relative rigid and able to be retained within the slotted recess 90. Preferably, the tubular portion has a Shore A durometer value of approximately 65 and the dart portion a Shore A durometer value of approximately 92. The preferred material for the gasket is a thermoplastic synthetic rubber sold under the trademark SANTOPRENE by the Monsanto Corporation.

Referring to FIG. 2, rear inner leg 76 of the head track 18 is configured as a mirror image of front inner leg 74 carrying gasket 96 in the rear recess 80. As shown in the installed condition, the upper extents of the wall panel top flanges 36, 38 are disposed within the front and rear recess 78, 80 of the head track, respectively. The tubular portions of the gaskets 82 and 96 are resiliently compressed and flexed against the inner surfaces 42 of the channel legs 40, 42. The gaskets thus provide a centering force on the wall panel to maintain the front and rear surfaces of the panel equally spaced apart from the outer legs 64, 66 of the head track. The gaskets further provide a seal against the passage of air and contaminants and dampen vibrations of the wall panel.

A series of longitudinally spaced holes 102 is formed through the inner web 68 of the head track between the inner legs 74, 76. These holes 102 are provided to allow the insertion of self-drilling, self-tapping screws 104 or other suitable fasteners upward through corresponding holes in the upper web 58 and into ceiling grid members 12 or other suitable overhead structure.

Still referring to FIG. 2, the floor track 20 is formed as an aluminum extrusion configured as upwardly opening elongated channel having a horizontally disposed bottom web 106 and front and rear legs 108, 110 extending upwardly from the edges of the bottom web. Along the top edges of the front and rear legs 108, 110 there are inwardly extending ledges 112, 114. Extending upwardly from the inner extents of the ledges are spacer walls 116, 118. Extending inwardly from the upper extents of the spacer walls are inclined ramping walls 120, 122.

The bottom edges of the wall panel front and rear bottom flanges 46, 48 rest atop the ledges 112, 114. The outer surfaces of the spacer walls 116, 118 contact the inner surfaces of the legs 50, 52 and thereby maintain the bottom flanges in proper position atop the ledges. The ramping walls 120, 122 stiffen the bottom track and provide inclined surfaces which aid in installing the wall panel by guiding the bottom flange lower edges into position. The floor track is formed to have its front-to-rear width substantially the same as that of the wall panel so that smooth and continuous lower wall surfaces are provided all the way to the floor.

The floor track is affixed to the floor F by screws 126 or other suitable fasteners inserted through holes 127 formed at intervals through the bottom web 106 and into the floor or other suitable substructure. Preferably, the holes 127 are longitudinally elongated so as to allow adjustment of the positions of the screws 126 to allow for alignment and to avoid interference with floor components.

Figure 4A:
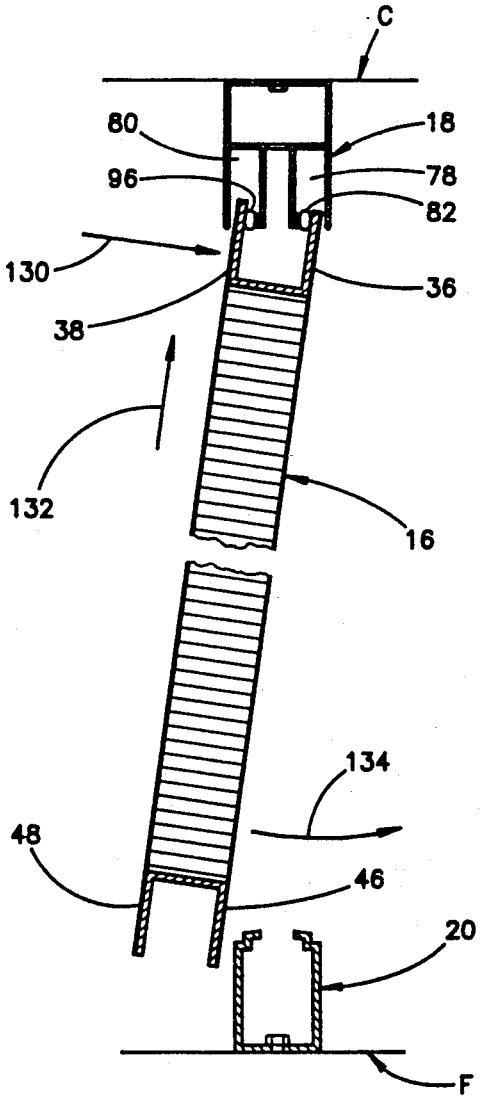
FIGS. 4*a* and 4*b* are vertical, sectional views illustrating the procedure for installing the clean room wall system of the invention.
Figure 4B:
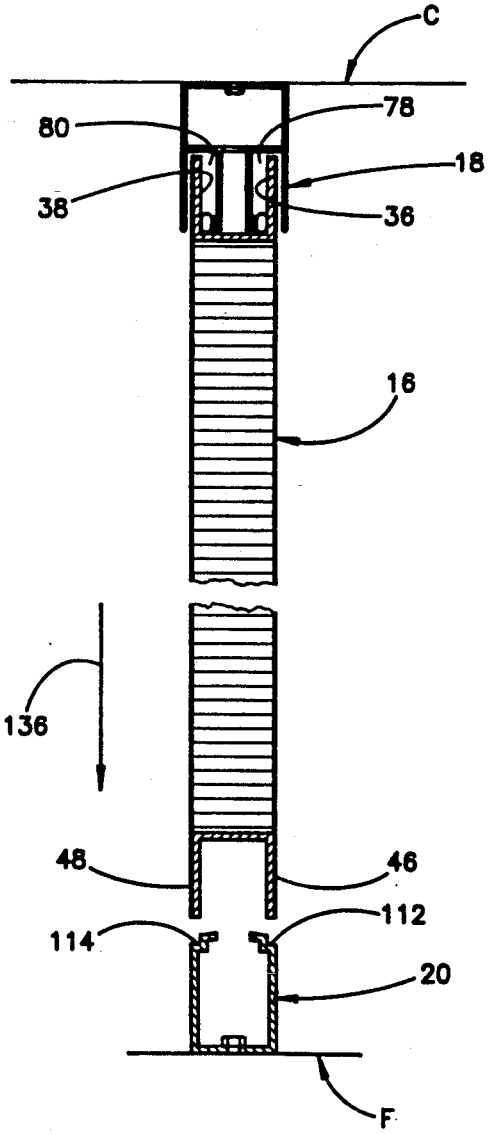

FIGS. **4*a* and 4*b* illustrate the procedure for installing the wall panels of the wall system of the invention. First, as shown in FIG. 4*a*, lengths of head and floor tracks 18 and 19 are affixed to the ceiling C and floor F directly above and below one another. A wall panel section 16 is then brought alongside the tracks. The distance between the top of the floor and the bottom edge of the top track 18 is greater than the height of the panel 16. The top of the panel is tilted toward the top track as indicated by arrow 130. The panel top flanges 36, 38 are positioned below the head track recesses 78 80. The panel is then lifted, as indicated by arrow 132**, with the top flanges straddling the gaskets.

Lifting of the panel is continued until the bottom edges of the bottom flanges are above the top of the floor track 20. The necessary panel lifting distance is made possible by the vertical depth of the head track recesses 78, 80 and the height of the panel top flanges 36, 38. Tilting or swinging of the wall panel while the top flanges are inserted within the head track recesses is made possible by the lateral width of the recesses and flexing of the gaskets.

When the panel bottom edge clears the floor track, the bottom of the panel is swung, as indicated by arrow 134, over the floor track into the vertical position shown in FIG. **4*b*. In this position, the top panel flanges 36, 38 extend fully into the head track recesses 78, 80. Finally as indicated by arrow 136, the panel is vertically lowered until the bottom edges of the bottom flanges 46, 48 rest atop the floor track ledges 112, 114 in the position shown in FIG. 2**.

The wall panel is demounted by reversing the above-described procedure. Namely, the panel is raised and the bottom is swung out to clear the floor track. Next, the panel is lowered until the top flanges are free of the head track recesses, and the panel is removed. The gaskets 82, 96 remain intact and in place throughout both installation and demounting.

Because it is necessary to swing the bottom edge of the panel out only a small distance in order to clear the floor track, it is possible to install the wall system of the invention in very tight or congested spaces.

Preferred dimensions for components of the wall panel system include a wall panel thickness and flange spacing of approximately 1.5 inches, an overall lateral head track width of approximately 2 inches, head track recess vertical depth and lateral width of approximately 1.5 inches and 0.5 inch respectively, and wall panel top flange height of approximately 1.75 inches. The bottom track is preferably approximately 1.5 inches in lateral overall width, and approximately 2 inches in height from the underside of the bottom track to the top surfaces of the ledges.

Referring again to FIG. 2, it may be seen that the head track 18 includes a longitudinal space 140 formed between the upper and lower webs 58, 68 and the front and rear outer legs 64, 66. This space may be used for the routing of wires, conduits, or the like, such as conduit 142 shown in outline. Similarly, a longitudinal space 144 is formed within floor track 20 through which lines such as conduits 146, 148 may be routed.

Figure 5:
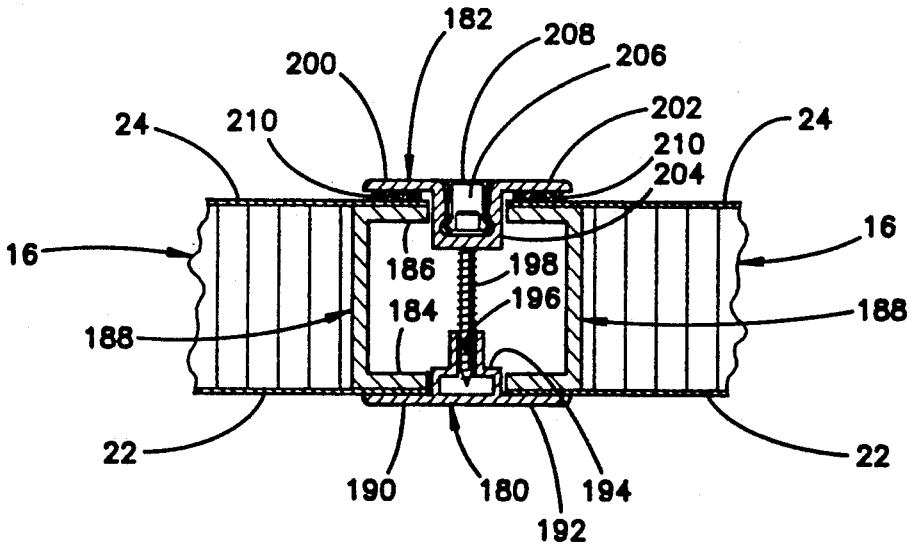
FIG. 5 is a sectional view taken along the line 5—5 of FIG. 1.
Figure 6:
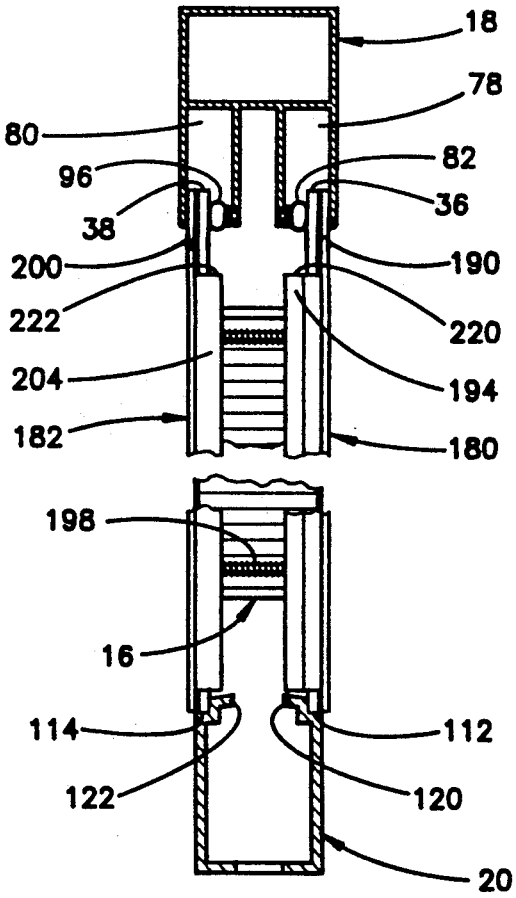
FIG. 6 is a sectional view taken substantially along the line 6—6 of FIG. 1.

Details of the construction of the vertical seams between adjacent wall panels may be seen in FIGS. 5 and 6. The vertical edges of the wall panels are formed by the edge portions of the front and rear faces 22, 24 overlying and adhered to the longitudinally directed legs 184, 186 of panel edge channels 188. A gap is formed between the adjacent edges of the two wall panels. Front batten strip 180 extends vertically along the front side of the gap and rear batten strip 182 extends along the rear side opposite the front batten strip.

Front batten strip 180 includes flanges 190, 192 which overlie the front surfaces of the edge portions of the wall panels. Vertically along the inner surface of the front batten strip between the flanges there is formed a central body 194 which extends into the gap between the panel edges. Central body 194 is formed with an inwardly opening longitudinal groove 196 which receives a fastener such as self-drilling, self-tapping screw 198.

Rear batten strip 182 includes flanges 200, 202 which overlie the rear surfaces of the edge portions of the wall panels. Vertically along the inner surface of the rear batten strip between the flanges there is formed a central body 204 which extends into the gap between the panel edges. The central body 204 is formed with an outwardly opening longitudinal recess 206 in which the fastener 198 is received and inserted through the central body into the groove of the front batten strip 180. A longitudinal cap 208 snap-fits in the recess 206 to conceal the fasteners and present a finished outer surface appearance. Resilient gaskets 210 are provided between the flanges 200, 202 to provide a seal between the rear batten strip and the wall panels. Preferably, the gaskets are pre-adhered to the batten strip flanges by pressure sensitive adhesive.

As illustrated in FIG. 6, in which only the wall panel 16 behind the batten strips is shown for clarity, the length of the batten strips 180, 182 is substantially the same as the height of the wall panels 16. However, the central bodies 194, 204 do not extend for the entire length of the batten strips. At the upper ends, the central bodies stop, as at 220, 222, a distance below the gaskets 82, 96 so as to avoid any interfering contact with the gaskets. The flanges 190, 192, 200, 202 of the batten strips continue upward beyond the central body into the front and rear recesses 78, 80 of the head track 18. The width of the of the head track recesses is formed to be sufficient to accept the batten strips as well as the top flanges 36, 38 of the wall panels.

At their lower ends, the flanges of the batten strip extend downwardly to approximately the level of the ledges 112, 114 of the floor track 20. The central bodies of the batten strips stop at a distance above the ramping walls 120, 122 to avoid interfering contact therewith.

Figure 7:
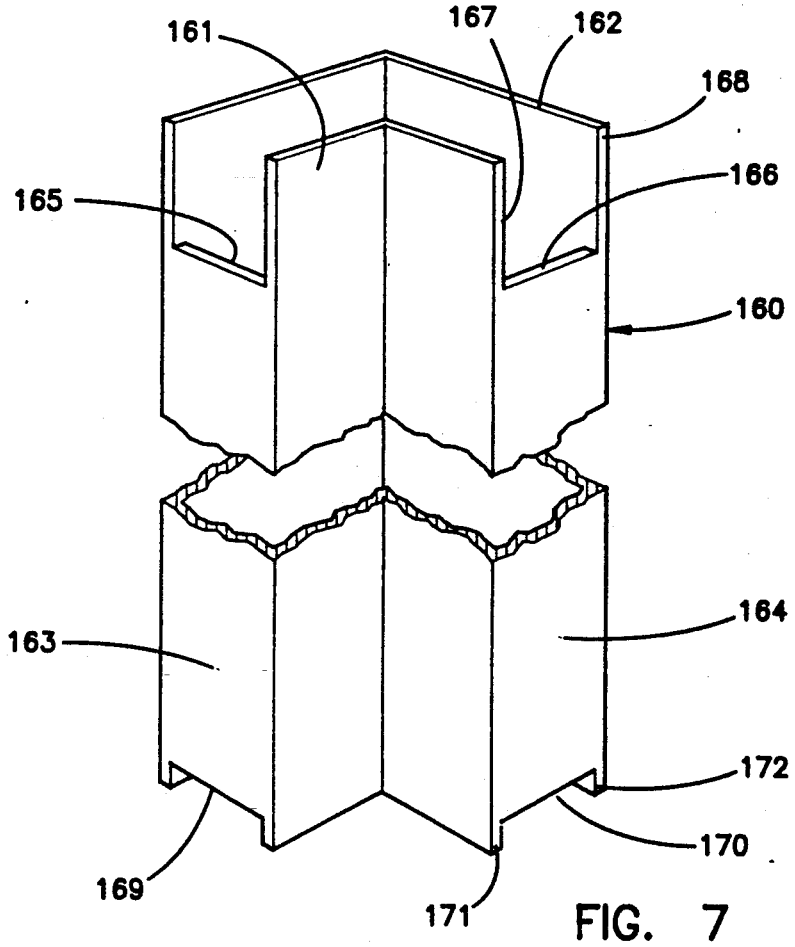
FIG. 7 is an isometric view of the corner post according to the invention.
Figure 8:
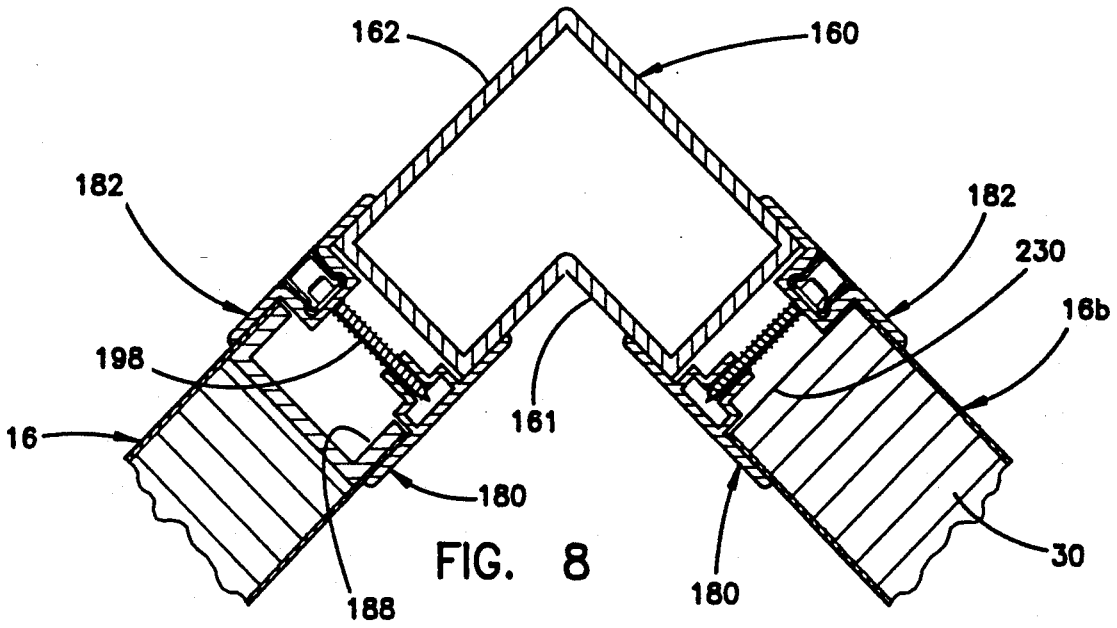
FIG. 8 is a sectional view taken along the line 8—8 of FIG. 1.

FIGS. 7 and 8 show details of the corner post 160 according to the invention. The corner post is preferably formed as an aluminum extrusion having laterally spaced-apart L-shaped front and rear walls 161, 162, and end walls 163, 164 extending between the vertical edges of the inner and outer walls. The overall vertical height of the corner post is substantially the same as that of the wall panels 16. However, the upper end portions of the end walls 163, 164 are notched or cut away as at 165, 166 to form top front and rear L-shaped flange portions 167, 168 on the front and rear walls 161, 162. The notching of the top of the post avoids any interfering contact between the end walls and the inner walls and gaskets of the head track. Preferably, the depth of the notches 165, 166 is approximately one and one-half inches. The corner post top flanges are of substantially the same height and thickness as the top flanges 36, 38 of the wall panels. Consequently, the top flanges of the corner post are received in the recesses of the head track straddling the gaskets therein in the same manner as the top flanges of the wall panels.

At the bottom of the corner post 160, the end walls 163, 164 are notched or cut away as at 169, 170 to form bottom front and rear L-shaped flange portions 171, 172. These notches avoid interference between the corner post end walls and the floor track. Preferably, the notches 169, 170 have a depth of approximately one-quarter inch. These bottom flanges of the corner post engage the ledges 112, 114 (FIG. 2) and spacer walls 116, 118 of the floor track in the same manner as the bottom flanges 46, 48.

Thus, the corner posts 160 are installed in the wall system in essentially the same manner as the wall panels 16. A corner post is brought into position alongside the corner joints of the head track and floor track. The top of the corner position is tilted under the head track. The top flanges 167, 168 are raised into the recesses 78, 80 of the head track with the top flanges straddling the gaskets 82, 96. The bottom of the corner post is swung in until it is directly over the floor track. The corner post is then lowered until the bottom flanges 171, 172 rest upon the ledges 112, 114 of the floor track.

FIG. 8 shows the assembly of the corner post 160 to adjacent wall panels 16, **16*b* by means of inner and outer batten strips 180, 182. The corner posts have a front to rear thickness substantially the same as the wall panels. Thus, the batten strips are used in essentially the same manner as with the assembly of vertical seams between two wall panels. The flanges of the batten strips overlie the adjacent edge portions of the front and rear surfaces of a wall panel and corner post. Fasteners 198** are used to capture the panel and corner post edges between the batten strips.

Wall panel 16 is shown in FIG. 8 as having a vertical edge with a channel 188 as described above. Wall panel **16*b*, however, has no edge channel. Instead, the honeycomb structural core 30** extends all the way to the vertical edge of the panel. This type of edge detail, which may be formed by cutting through an intermediate portion of the panel, works equally well with the batten strip seam assemblies.

The assembly details of the wall system according to the invention, and the minimal degree of field fabrication required thereby, allow for factory finishing of each of the components. As mentioned above, the wall panel major surfaces may be coated with a durable finishing material, as may the corner posts. The head tracks and batten strips are preferably anodized.

The above description is that of a preferred embodiment of the invention. Various alterations and changes can be made without departing from the spirit and broader aspects of the invention as set forth in the appended claims, which are to be interpreted in accordance with the principles of patent law, including the Doctrine of Equivalents.

The embodiments of the invention in which an exclusive property or privilege is claimed are defined as follows:

1. A wall construction comprising:

a wall panel having front and rear laterally spaced-apart, generally parallel major surfaces and top and bottom longitudinal edges; and a pair of laterally spaced-apart, generally parallel top flanges extending longitudinally and upwardly from said wall panel top edge;

a longitudinally extending head track having front and rear laterally spaced-apart, longitudinally extending, generally parallel outer legs defining a downwardly opening space therebetween; inner leg means disposed longitudinally between said front and rear head track legs generally parallel thereto, said inner leg means dividing said space into longitudinal front and rear recesses; and resilient longitudinal gasket means carried on said inner leg means and extending laterally into said front and rear recesses;

a longitudinally extending floor track disposed substantially below and spaced-apart from said head track and having a bottom portion adapted to rest upon a floor; and a top edge portion disposed spaced apart and above said bottom portion;

wherein said wall panel top flanges are received within said head track front and rear recesses straddling said gasket means and resiliently compressing said gasket means therebetween, wherein said wall panel bottom edge rests atop said floor track top edge portion, wherein the vertical depth of said head track front and rear recesses and the vertical height of said wall panel top flanges are sufficient to allow the wall panel to be raised such that the bottom edge of said wall panel disengages from said floor track, and wherein the lateral widths of said head track front and rear recesses are sufficient to allow the bottom of the raised wall panel to be swung laterally a distance sufficient to clear said floor track.

2. The wall construction of claim 1 wherein said gasket means comprises first and second gaskets, said first gasket extending into said head track front recess and said second gasket extending into said head track rear recess.

3. The wall construction of claim 2 wherein said first and second gaskets each comprise a longitudinal base portion engaging said inner leg means and a longitudinal tubular portion in resiliently flexed contact with one of said top flanges.

4. The wall construction of claim 3 wherein said first and second gaskets each comprise a dual durometer coextrusion, said base portion having a relatively higher durometer value and said tubular portion having a relatively lower durometer value.

5. The wall construction of claim 1 wherein said head track inner leg means comprises generally parallel and laterally spaced-apart front and rear inner legs, said head track front recess being defined between said front outer leg and said front inner leg, said rear recess being defined between said rear outer leg and said rear inner leg.

6. The wall construction of claim 5 further comprising a longitudinally slotted recess formed along the lower extent of each of said front and rear inner legs and opening laterally toward the associated front or rear recess, and wherein said gasket means comprises front and rear longitudinal gaskets each having a dart means engaging the slotted recess of the associated front or rear inner leg.

7. The wall construction of claim 6 wherein each of said front and rear gaskets further comprise a resiliently flexible tubular portion extending into said front or rear recess contacting said wall panel top flanges.

8. The wall construction of claim 1 wherein said floor track comprises front and rear laterally spaced-apart legs defining a space therebetween and said floor track top edge portion comprises front and rear inwardly extending ledges formed along the upper extents of said floor track front and rear legs, and wherein said wall panel bottom edge rests upon said front and rear ledges.

9. The wall construction of claim 8 wherein said wall panel bottom edge comprises a pair of laterally spaced-apart, generally parallel bottom flanges extending longitudinally and downwardly, and wherein the bottom extents of said bottom flanges rest upon said floor track ledges.

10. The wall construction of claim 9 further comprising front and rear spacer wall means extending upwardly from the inner extents of said front and rear ledges for engaging said wall panel bottom flanges and maintaining said flanges in position upon said ledges.

11. The wall construction of claim 1 further comprising a plurality of said wall panels in substantially coplanar edge-to-edge relationship, wherein said head track comprises a unitary member extending along the upper edges of each of said wall panels and wherein said gasket means extends continuously in engagement with each of said wall panels.

12. The wall construction of claim 1 further comprising a plurality of said wall panels in substantially coplanar relationship having adjacent vertical edges portions, and vertically elongated front and rear batten strips extending overlying said vertical edge portions and extending upwardly into said head track front and rear recesses.

13. The wall construction of claim 1 further comprising a corner having a corner post disposed adjacent a vertical edge of said wall panel, said corner post having spaced apart substantially L-shaped front and rear walls in generally coplanar relationship with said wall panel major surfaces.

14. A demountable wall construction for installation between a floor and a ceiling comprising:

a wall panel including:

a front surface and a rear surface in laterally spaced-apart, parallel relationship, each of said front and rear surfaces having a top edge and a bottom edge;

a first top flange extending upwardly from said front surface top edge and a second top flange extending upwardly from said rear surface top edge;

a first bottom flange extending downwardly from said front surface bottom edge and a second bottom flange extending downwardly from said rear surface bottom edge; and a longitudinally extending head track including:

downwardly extending front and rear outer legs in laterally spaced, parallel relationship defining a downwardly opening space therebetween;

a first longitudinal web portion extending horizontally, laterally between said front and rear outer legs;

a second longitudinal web portion extending horizontally, laterally between said front and rear outer legs and disposed spaced-apart above said first web portion thereby defining a space therebetween;

inner leg means extending downwardly disposed between said front and rear outer legs for dividing said space into front and rear longitudinal recesses;

resilient gasket means carried on said inner leg means extending laterally into said front and rear recesses;

means for affixing said head track to the ceiling;

a longitudinally extending floor track disposed directly below said head track and including:

upstanding front and rear legs in laterally spaced, parallel relationship; and a first ledge extending laterally inwardly along the upper extent of said floor track front leg and a second ledge extending laterally inwardly along the upper extent of said floor track rear leg, said first and second ledge disposed spaced a distance above said floor;

means for affixing said floor track to the floor;

said wall panel extending generally vertically between said head track and said floor track with said first and second top flanges disposed within said front and rear recesses of said head track straddling said gasket means and resiliently compressing said gasket means therebetween, and with said first and second bottom flanges having their bottom extents resting upon said first and second ledges of said floor track.

15. The wall construction of claim 14 wherein said wall panel further comprises a structural core, front and rear facer plates overlyingly bonded to said core, an upwardly opening top channel member disposed along the upper extent of said core having upwardly extending and laterally spaced apart front and rear legs forming said first and second top flanges, a downwardly opening bottom channel member disposed along the lower extent of said core having downwardly extending and laterally spaced-apart front and rear legs forming said first and second bottom flanges.

16. The wall construction of claim 14 further comprising conduit means routed through said space between said first and second web portions.

17. The wall construction of claim 16 further comprising a plurality of central portion holes formed through a laterally central portion said first web portion disposed at longitudinally spaced intervals therealong and wherein said means for affixing said head track to said ceiling comprises a plurality of fasteners inserted upwardly through said holes, through said second web portion and into said ceiling.

18. The wall construction of claim 14 wherein the vertical depth and lateral width of said front and rear recesses and the vertical height of said first and second top flanges are dimensioned such that said wall panel may be raised and lowered and the bottom extent of said wall panel may be swung laterally in and out for installation and demounting of the wall panel.

19. A wall construction comprising:

a wall panel having front and rear laterally spaced-apart, generally parallel major surfaces and top and bottom longitudinal edges, a pair of laterally spaced-apart, generally parallel top flanges extending longitudinally and upwardly from said wall panel top edge, and a pair of laterally spaced-apart, generally parallel bottom flanges extending longitudinally and downwardly from said bottom edge;

a longitudinally extending head track having front and rear laterally spaced-apart, longitudinally extending, generally parallel outer legs defining a downwardly opening space therebetween; inner leg means disposed longitudinally between said front and rear head track legs generally parallel thereto, said inner leg means dividing said space into longitudinal front and rear recesses; and resilient longitudinal gasket means carried on said inner leg means and extending laterally into said front and rear recesses;

a longitudinally extending floor track disposed substantially below and spaced-apart from said head track and having a bottom portion adapted to rest upon a floor, front and rear laterally spaced-apart legs defining a space therebetween, front and rear inwardly extending ledges formed along the upper extents of said floor track front and rear legs, and front and rear spacer wall means extending upwardly from the inner extents of said front and rear ledges;

wherein said wall panel top flanges are received within said head track front and rear recesses straddling said gasket means and resiliently compressing said gasket means therebetween, and wherein the bottom extents of said bottom flanges of said wall panel bottom edge rests atop said floor track ledges with said front and rear spacer wall means engaging said wall panel bottom flanges and maintaining said flanges in position atop said ledges.

20. The wall construction of claim 19 further comprising front and rear ramping wall means extending inclined upwardly and inwardly from the upper extents of said front and rear spacer wall means for guiding said wall panel bottom flanges into position upon said ledges.

21. The wall construction of claim 9 wherein said wall panel front rear surfaces extend substantially smoothly and continuously from the upper extent of said top flanges to the lower extent of said bottom flanges.

22. A wall construction comprising:

a plurality of wall panels in substantially coplanar relationship having adjacent vertical edge portions, each of said wall panels having front and rear laterally spaced-apart, generally parallel major surfaces and top and bottom longitudinal edges; and a pair of laterally spaced-apart, generally parallel top flanges extending longitudinally and upwardly from said wall panel top edge;

a longitudinally extending head track having front and rear laterally spaced-apart, longitudinally extending, generally parallel outer legs defining a downwardly opening space therebetween; inner leg means disposed longitudinally between said front and rear head track legs generally parallel thereto, said inner leg means dividing said space into longitudinal front and rear recesses; and resilient longitudinal gasket means carried on said inner leg means and extending laterally into said front and rear recesses;

a longitudinally extending floor track disposed substantially below and spaced-apart from said head track and having a bottom portion adapted to rest upon a floor; and a top edge portion disposed spaced apart and above said bottom portion;

vertically elongated front and rear batten strips extending overlying said vertical edge portions and extending upwardly into said head track front and rear recesses;

wherein said wall panel top flanges are received within said head track front and rear recesses straddling said gasket means and resiliently compressing said gasket means therebetween, and wherein said wall panel bottom edge rests atop said floor track top edge portion.

23. The wall construction of claim 22 wherein said adjacent wall panel vertical edge portions are spaced apart, said front and rear batten strips including flanges overlying said vertical plates overlyingly bonded to said core, an upwardly opening top channel member disposed along the upper extent of said core having upwardly extending and laterally spaced apart front and rear legs forming said first and second top flanges, a downwardly opening bottom channel member disposed along the lower extent of said core having downwardly extending and laterally spaced-apart front and rear legs forming said first and second bottom flanges.

24. A wall construction comprising:

a wall panel having front and rear laterally spaced-apart, generally parallel major surfaces and top and bottom longitudinal edges; and a pair of laterally spaced-apart, generally parallel top flanges extending longitudinally and upwardly from said wall panel top edge;

a longitudinally extending head track having front and rear laterally spaced-apart, longitudinally extending, generally parallel outer legs defining a downwardly opening space therebetween; inner leg means disposed longitudinally between said front and rear head track legs generally parallel thereto, said inner leg means dividing said space into longitudinal front and rear recesses; and resilient longitudinal gasket means carried on said inner leg means and extending laterally into said front and rear recesses;

a longitudinally extending floor track disposed substantially below and spaced-apart from said head track and having a bottom portion adapted to rest upon a floor; and a top edge portion disposed spaced apart and above said bottom portion;

a corner post disposed adjacent a vertical edge of said wall panel, said corner post having spaced apart substantially L-shaped front and rear walls in generally coplanar relationship with said wall panel major surfaces;

wherein said wall panel top flanges are received within said head track front and rear recesses straddling said gasket means and resiliently compressing said gasket means therebetween, and wherein said wall panel bottom edge rests atop said floor track top edge portion.

25. A demountable wall construction for installation between a floor and a ceiling comprising:

a wall panel including:

a structural core, front and rear facer plates in laterally spaced-apart, parallel relationship, and overlyingly bonded to said core;

an upwardly opening, longitudinal top channel member disposed along the upper extent of said core having upwardly extending and laterally spaced apart front and rear legs;

a downwardly opening, longitudinal bottom channel member disposed along the lower extent of said core having downwardly extending and laterally spaced-apart front and rear legs;

a longitudinally extending head track including:

downwardly extending front and rear outer legs in laterally spaced, parallel relationship defining a downwardly opening space therebetween;

inner leg means extending downwardly disposed between said front and rear outer legs for dividing said space into front and rear longitudinal recesses;

resilient gasket means carried on said inner leg means extending laterally into said front and rear recesses;

means for affixing said head track to the ceiling;

a longitudinally extending floor track disposed directly below said head track and including:

upstanding front and rear legs in laterally spaced, parallel relationship; and a first ledge extending laterally inwardly along the upper extent of said floor track front leg and a second ledge extending laterally inwardly along the upper extent of said floor track rear leg, said first and second ledge disposed spaced a distance above said floor;

means for affixing said floor track to the floor;

said wall panel extending generally vertically between said head track and said floor track with said front and rear legs of said top channel member disposed within said front and rear recesses of said head track straddling said gasket means and resiliently compressing said gasket means therebetween, and with said front and rear legs of said bottom channel member having their bottom extents resting upon said first and second ledges of said floor track.

26. The wall construction of claim 25 wherein said head track inner leg means comprises laterally spaced-apart front inner leg and rear inner leg, said front longitudinal recess defined between said front outer leg and said front inner leg, said rear longitudinal recess defined between said rear outer leg and said rear inner leg.

27. The wall construction of claim 26 wherein said front and rear inner legs are each formed with a laterally opening longitudinally slotted recess opening toward said respective front and rear outer legs, and wherein said means for providing a resilient gasket comprises first and second resilient gaskets each engaging one of said slotted recesses and extending laterally into a respective one of said front and rear recesses.

28. The wall construction of claim 27 wherein each of said first and second resilient gaskets comprises a longitudinally extending base portion forming a dart engaged in one of said slotted recesses and a longitudinally extending tubular portion flexibly contacting a respective one of said wall panel top flanges and forming a seal therewith.

29. The wall construction of claim 28 wherein each of said first and second resilient gaskets comprises a dual durometer coextrusion of synthetic rubber material, said base portion comprising a relatively rigid and high durometer value portion, and said tubular portion comprising a relatively flexible and low durometer value portion.

30. A demountable wall construction for installation between a floor and a ceiling comprising:

a wall panel including:

a front surface and a rear surface in laterally spaced-apart, parallel relationship, each of said front and rear surfaces having a top edge and a bottom edge;

a first top flange extending upwardly from said front surface top edge and a second top flange extending upwardly from said rear surface top edge;

a first bottom flange extending downwardly from said front surface bottom edge and a second bottom flange extending downwardly from said rear surface bottom edge; and a longitudinally extending head track including:

downwardly extending front and rear outer legs in laterally spaced, parallel relationship defining a downwardly opening space therebetween;

inner leg means extending downwardly disposed between said front and rear outer legs for dividing said space into front and rear longitudinal recesses;

resilient gasket means carried on said inner leg means extending laterally into said front and rear recesses;

means for affixing said head track to the ceiling;

a longitudinally extending floor track disposed directly below said head track and including:

upstanding front and rear legs in laterally spaced, parallel relationship; and a first ledge extending laterally inwardly along the upper extent of said floor track front leg and a second ledge extending laterally inwardly along the upper extent of said floor track rear leg, said first and second ledge disposed spaced a distance above said floor;

means for affixing said floor track to the floor;

said wall panel extending generally vertically between said head track and said floor track with said first and second top flanges disposed within said front and rear recesses of said head track straddling said gasket means and resiliently compressing said gasket means therebetween, and with said first and second bottom flanges having their bottom extents resting upon said first and second ledges of said floor track;

wherein the vertical depth and lateral width of said front and rear recesses and the vertical height of said first and second top flanges are dimensioned such that said wall panel may be raised and lowered and the bottom extent of said wall panel may be swung laterally in and out for installation and demounting of the wall panel.

31. The wall construction of claim 30 further comprising a plurality of said wall panels in coplanar substantially vertical edge-to-edge relationship, wherein said head track and said gasket means extend continuously across the top flanges of adjacent wall panels.

32. A demountable wall construction for installation between a floor and a ceiling comprising:

a wall panel including:

a front surface and a rear surface in laterally spaced-apart, parallel relationship, each of said front and rear surfaces having a top edge and a bottom edge;

a first top flange extending upwardly from said front surface top edge and a second top flange extending upwardly from said rear surface top edge;

a first bottom flange extending downwardly from said front surface bottom edge and a second bottom flange extending downwardly from said rear surface bottom edge; and a longitudinally extending head track including:

downwardly extending front and rear outer legs in laterally spaced, parallel relationship defining a downwardly opening space therebetween;

inner leg means extending downwardly disposed between said front and rear outer legs for dividing said space into front and rear longitudinal recesses;

resilient gasket means carried on said inner leg means extending laterally into said front and rear recesses;

means for affixing said head track to the ceiling;

a longitudinally extending floor track disposed directly below said head track and including:

a longitudinally extending bottom web;

laterally spaced-apart front and rear legs extending upwardly from said web and defining a space therebetween;

a first ledge extending laterally inwardly along the upper extent of said floor track front leg and a second ledge extending laterally inwardly along the upper extent of said floor track rear leg, said first and second ledge disposed spaced a distance above said floor;

means for affixing said floor track to the floor; and conduit means routed through said space defined between said floor track front and rear legs;

said wall panel extending generally vertically between said head track and said floor track with said first and second top flanges disposed within said front and rear recesses of said head track straddling said gasket means and resiliently compressing said gasket means therebetween, and with said first and second bottom flanges having their bottom extents resting upon said first and second ledges of said floor track.

33. The wall construction of claim 32 wherein said means for affixing said floor track to the floor comprises a plurality of holes formed through said floor track bottom web at spaced intervals therealong and a plurality of fasteners inserted through said holes into said floor.

34. A demountable wall construction for installation between a floor and a ceiling comprising:

a wall panel including:

a front surface and a rear surface in laterally spaced-apart, parallel relationship, each of said front and rear surfaces having a top edge and a bottom edge;

a first top flange extending upwardly from said front surface top edge and a second top flange extending upwardly from said rear surface top edge;

a first bottom flange extending downwardly from said front surface bottom edge and a second bottom flange extending downwardly from said rear surface bottom edge; and a longitudinally extending head track including:

downwardly extending front and rear outer legs in laterally spaced, parallel relationship defining a downwardly opening space therebetween;

inner leg means extending downwardly disposed between said front and rear outer legs for dividing said space into front and rear longitudinal recesses;

resilient gasket means carried on said inner leg means extending laterally into said front and rear recesses;

means for affixing said head track to the ceiling;

a longitudinally extending floor track disposed directly below said head track and including:

upstanding front and rear legs in laterally spaced, parallel relationship; and a first ledge extending laterally inwardly along the upper extent of said floor track front leg and a second ledge extending laterally inwardly along the upper extent of said floor track rear leg, said first and second ledge disposed spaced a distance above said floor;

means for affixing said floor track to the floor; and a corner post having substantially L-shaped front and rear surfaces in laterally spaced-apart, parallel relationship, the upper extents of said front and rear corner post surfaces including top flanges received in said head track recesses straddling said gasket means, the lower extents of said corner post front and rear surfaces including bottom flanges resting upon said first and second ledges of said floor track;

said wall panel extending generally vertically between said head track and said floor track with said first and second top flanges disposed within said front and rear recesses of said head track straddling said gasket means and resiliently compressing said gasket means therebetween, and with said first and second bottom flanges having their bottom extents resting upon said first and second ledges of said floor track.

35. A demountable wall construction for installation between a floor and a ceiling comprising:

at least two wall panels in coplanar, substantially vertical, edge-to-edge spaced-apart adjacency, each of said wall panels including:

a front surface and a rear surface in laterally spaced-apart, parallel relationship, each of said front and rear surfaces having a top edge and a bottom edge;

a first top flange extending upwardly from said front surface top edge and a second top flange extending upwardly from said rear surface top edge;

a first bottom flange extending downwardly from said front surface bottom edge and a second bottom flange extending downwardly from said rear surface bottom edge; and a longitudinally extending head track including:

downwardly extending front and rear outer legs in laterally spaced, parallel relationship defining a downwardly opening space therebetween;

inner leg means extending downwardly disposed between said front and rear outer legs for dividing said space into front and rear longitudinal recesses;

resilient gasket means carried on said inner leg means extending laterally into said front and rear recesses;

means for affixing said head track to the ceiling;

a longitudinally extending floor track disposed directly below said head track and including:

upstanding front and rear legs in laterally spaced, parallel relationship; and a first ledge extending laterally inwardly along the upper extent of said floor track front leg and a second ledge extending laterally inwardly along the upper extent of said floor track rear leg, said first and second ledge disposed spaced a distance above said floor;

means for affixing said floor track to the floor; and front and rear vertically elongated batten strips extending along the adjacent vertical edge portions of said wall panels, each of said batten strips including flange portions overlying the outer surfaces of said wall panel edge portions and central bodies extending inwardly between said wall panel edge portions, said battens trip flanges extending vertically to substantially the same extent as said wall panels and said wall panel top and bottom flanges, said central bodies extending vertically to a lesser extent than said batten strip flanges so as to avoid interfering contact with said head track inner leg means;

said wall panel extending generally vertically between said head track and said floor track with said first and second top flanges disposed within said front and rear recesses of said head track straddling said gasket means and resiliently compressing said gasket means therebetween, and with said first and second bottom flanges having their bottom extents resting upon said first and second ledges of said floor track.

* * * * *

UNITED STATES PATENT AND TRADEMARK OFFICE

CERTIFICATE OF CORRECTION

PATENT NO. : 5,228,254

DATED : July 20, 1993

INVENTOR(S) : James R. Honeycutt, Jr.

It is certified that error appears in the above-identified patent and that said Letters Patent is hereby corrected as shown below:

Title page, item [57],
In the Abstract, Line 1:
"domountable" should be --demountable--.

Column 13, claim 17, line 68:
before "holes" delete --central portion--.

Column 14, claim 17, line 1:
after "portion" insert --of--.

Column 15, claim 23, line 34:
after "vertical" delete all language to the end of the claim and insert --edge portions and central bodies extending inwardly between said vertical edge portions, said central bodies extending vertically to a lesser extent than said flanges so as to avoid interfering contact with said head track and said floor track--.

Column 20, claim 35, line 42:
"trip" should be --strip--.

Signed and Sealed this

Fifteenth Day of March, 1994

*Attest:*

Bruce Lehman

BRUCE LEHMAN

*Attesting Officer*

*Commissioner of Patents and Trademarks*